United States Patent [19]

Bogh

[11] Patent Number: 4,852,331

[45] Date of Patent: Aug. 1, 1989

[54] METHOD AND APPARATUS FOR PACKAGING A NUMBER OF PACKAGES OF GENERALLY ELASTIC INSULATION MATERIAL

[75] Inventor: Bo B. Bogh, Roskilde, Denmark

[73] Assignee: Rockwool International A/S, Denmark

[21] Appl. No.: 132,474

[22] Filed: Dec. 14, 1987

[30] Foreign Application Priority Data

Dec. 22, 1986 [DK] Denmark ..... 6216/86

[51] Int. Cl.[4] ..... B65B 1/26; B65B 13/04; B65B 27/12; B65B 63/02

[52] U.S. Cl. ..... 53/399; 53/432; 53/438; 53/510; 53/529; 53/588

[58] Field of Search ..... 53/211, 218, 432, 433, 53/436, 438, 444, 465, 510, 511, 512, 523, 528, 529, 588, 399

[56] References Cited

U.S. PATENT DOCUMENTS

| | | | |
|---|---|---|---|
| 3,307,319 | 3/1967 | Christensen et al. | 53/436 X |
| 3,321,889 | 5/1967 | Zubik et al. | 53/511 X |
| 3,429,095 | 2/1969 | Huson . | |
| 3,458,966 | 8/1969 | Dunbar et al. | 53/436 X |
| 3,499,261 | 3/1970 | Hullhorst et al. | 53/432 X |
| 3,521,424 | 7/1970 | Wirfel | 53/434 X |
| 4,067,174 | 1/1978 | Goldstein | 53/588 X |
| 4,109,445 | 8/1978 | Shulman | 53/588 X |
| 4,369,614 | 1/1983 | Tetzner | 53/588 X |
| 4,409,776 | 10/1983 | Usui . | |
| 4,535,587 | 8/1985 | Rias | 53/436 |

FOREIGN PATENT DOCUMENTS 1147445 4/1969 United Kingdom .

*Primary Examiner*—Robert L. Spruill
*Assistant Examiner*—Beth Bianca
*Attorney, Agent, or Firm*—Ostrolenk, Faber, Gerb & Soffen

[57] ABSTRACT

A system for packaging a number of substantially cylindrical packages of generally elastic insulation material. The packages have open ends but are surrounded by a substantially airtight foil layer. The packages are placed close to one another and their ends are temporarily, essentially airtightly closed. The packages are pressed closely against each other by holders. The packages are then connected to a vacuum through a perforated plate to reduce their volume. The reduced volume packages are then wrapped within a tight foil enclosure after the holders are removed but before the vacuum is disconnected. The system not only reduces the volume of the individual packages but also eliminates interspaces therebetween.

8 Claims, 1 Drawing Sheet

METHOD AND APPARATUS FOR PACKAGING A NUMBER OF PACKAGES OF GENERALLY ELASTIC INSULATION MATERIAL

BACKGROUND OF THE INVENTION

1. Field of the Invention

The present invention relates to a method and an apparatus for packaging a number of substantially cylindrical packages consisting of a within certain limits elastic insulation material, for instance mineral wool, said packages having open ends, but being at their side faces surrounded by a substantially airtight foil layer, by which method the open ends of the packages are temporarily closed in an essentially airtight way, the volume encased by the foil layer and the temporary sealings being connected to a vacuum source to reduce the volume of the packages, the packages thus reduced being enclosed in a tight enclosure before the vacuum is disconnected.

2. Description of Related Art

A method of this kind has been disclosed in the U.S. Pat. No. 3,458,966. According to this known method a single roll of insulation material is placed in an airtight plastic bag, the bag being then evacuated, and, as a consequence, the insulation material is compressed by the surrounding air, until the volume has been reduced to such an extent that the bag with the insulation material may be placed in a sleeve with open ends, said sleeve having a diameter somewhat smaller than the original diameter of the roll. When the vaccum is suspended, the insulation material will try to regain its original volume, but is prevented therefrom by the sleeve. If the insulation material is provided with a covering of an essentially airtight material forming an outer side of the coil during the rolling, said covering may be used as a kind of enclosure with open ends, the package only having to be closed at the ends at the evacuation. For this purpose a cap is proposed. According to this known method only individual packaging of the cylindrical packages is disclosed, said packages retaining also after their insertion in the sleeve their cylindrical shape. The cylindrical shape is not advantageous for a later putting together of the packages on pallets, and the individual enclosing of each package in a separate enclosure is considerably material consuming.

In the patent it is ascertained that the compression of the insulation material by means of vacuum is more advantageous than other types of compression, as the degree of compression, which is tolerable without loosing the capability of the insulation material of regaining its original form, is higher by compression by means of vacuum than by means of other mechanical means. The idea of the invention is to use this gentle compression in a special way in order to obtain the maximum use of a given transport volume.

SUMMARY OF THE INVENTION

The object of the present invention is to reduce the costs of wrapping insulation materials before dispatch, a high degree of compression and a full utilization of a given transport volume being aimed at, as well as a low consumption of plastics or other materials for providing the approximately airtight encasing and the tight enclosure.

This object is achieved by the present invention. By means of the close putting together, whereby the airtight enclosures touch each other, it becomes possible not only to compress the packages themselves, but also to evacuate and reduce the hollow spaces between the closely packed packages. It thereby becomes possible to produce an approximately boxshaped compact package when using the arrangement with the rectangular pattern. The foil which may consist of plastics or paper is distinguished by having a great flexibility and by low cost in relation to its strength, whereby the second encasing, which after the discontinuation of the evacuation keeps the packages compressed, may be established in a most economical way. The wrapping is particularly useful for packages consisting of coiled mineral wool, where the packages, due to the structure of the mineral wool, are compressible to a smaller diameter, but possibly also to a sectional shape differing from the originally nearly circular section. Tests have shown that coiled mineral wool in lengths may be compressed to about one fourth of its original volume through a combination of a tight coiling and a subsequent packing in accordance with the present invention. The method according to the invention is, however, not limited to packages consisting of coiled mineral wool, but can also be used in connection with stacks of mineral wool slabs, each stack being provided with an enclosure of a foil layer. On account of the structure of the mineral wool, such packages will not by the evacuation obtain the same degree of compression in all directions, but a 25 per cent reduction of the volume in addition to the compression already established by the wrapping with the foil layer may be attained directly.

During the evacuation the packages are being pressed against each other by the holding means in such a way that the sealing along the contacting lines between the packages will not be broken, and in such a way that the evacuated arrangement of packages gets the desired geometrical form. A particularly advantageous arrangement consists of nine packages put together in three rows, each row containing three packages. By this arrangement, the package in the middle gets a completely quadratic outline, and the adjacent packages get a similar outline. This compression can be used for maximum exploitation of a given pallet size, the result being an optimum transport economy when dispatching the packages.

When compressing a quadractic arrangement of nine packages it has proved advantageous to make the evacuation of the five packages in the middle particularly effective, and more effective than the evacuation of the four corner packages. By this method a more regular form of the total arrangement of packages is obtained, which is particularly of importance when the packages are to be placed on pallets, as the dimension of the pallet should not be surpassed, and as, on the other hand, the compression should not exceed the limit of the elasticity of the insulating material.

The invention also relates to an apparatus for carrying out the method.

BRIEF DESCRIPTION OF THE DRAWING

The invention will be described more closely in the following, reference being made to the drawing, which schematically shows an apparatus according to the invention. In the drawing.

DESCRIPTION OF THE PREFERRED EMBODIMENTS

Figure 1:
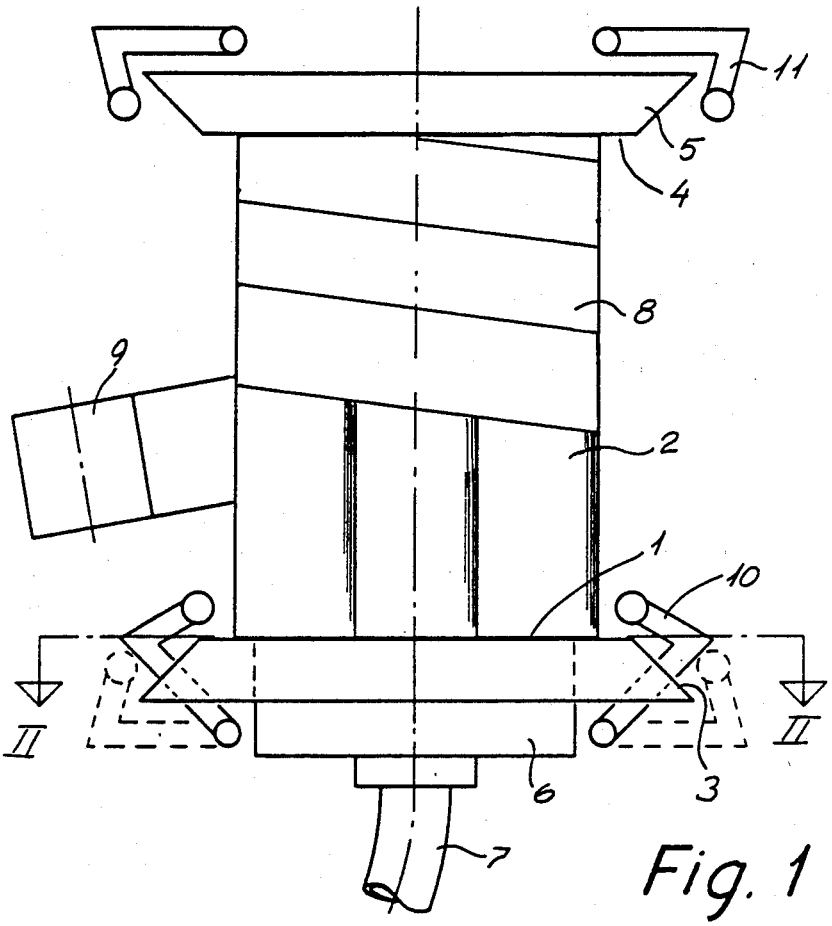
FIG. 1 shows the apparatus according to the invention seen from the side.

The object of the method according to the invention is to compress a number of packages, each of which contains a tightly coiled mineral wool web with an enclosure of a strong foil, the packages having been placed closely together to reduce the total base area of the packages, or a stack of mineral wool slabs being around their long side faces surrounded by a tight foil layer. It has been found that if the mineral wool, in addition to the compression taking place during the coiling and which normally will amount to 25–70 percent of the height of the mineral wool web, can be compressed approx. 25 percent more, nine mineral wool coils of the common size will just take up the area of a standardized loading pallet, which will make the transport of the mineral wool coils cheaper by exploiting the area of pallets thoroughly. A similar effect will be attainable. in connection with packages consisting of mineral wool slabs, even though the total compression on account of the varying elasticity in different directions of the mineral wool usually is somewhat smaller. As the further compression by means of the method according to the invention is achieved by means of evacuation of the air contained in the mineral wool and not by a simple mechanical influence, the packages can change their shape so much that also the interspaces between the packages are being filled out, the limits of the elasticity of the mineral wool not being exceeded. According to the method a number of packages—normally nine, said packages being enclosed in an enclosure which is open at the ends and which consists of paper or foil, is arranged close to one another on a plate 1 as shown in FIG. 1 to form a rectangular pattern. The plate 1 is of such a size that its edges substantially exactly circumscribe the outline of the packages 2 put together. The plate has along its periphery a shirt 3 forming an angle with the plate 1. Then a second plate 4 is lowered and brought to rest on the upper surface of the packages, said plate having the same shape as the plate 1. The plate 4 is like the plate 1 provided with a shirt 5. The movement of the plate 4 may be carried out by means of suitable (not shown) lifting means making it possible to move the plate 4 vertically upwards and downwards. Under the plate 1 a suction box 6 is mounted, said box being connected to a vacuum source (not. shown) by means of a vacuum conduit or tube 7. The plate 1 has been provided with perforations making it possible to evacuate the air present in the packages 2 of mineral wool. When the plate 4 is lowered towards the arranged packages, there is under normal conditions an approximately airtight enclosure of the volume contained in the packages, and under these conditions the evacuation can be brought about right away. If, however, it can be immediately ascertained that the enclosure is deficient, for instance because one of the sleeves has been torn, the packages may, to attain an adequately good sealing between the sleeves surrounding the individual packages and the plates 1,4 and the packages mutually in order to make it possible to create a strong vacuum in and between the packages, be wrapped by a first foil layer 8 from a foil roll 9, which is part of some (not shown) wrapping means, said wrapping means being adapted to perform a circling movement around the arrangement of packages 2. Simultaneously with the circling movement the wrapping means are also adapted to move upwards and downwards, whereby the packages 2 can be wrapped over their total height. When performing the first wrapping, care should be taken that the wrapping reaches the oblique shirt on the plates 1,4, the sealing between plates and and package ends being thereby considerably improved. The wrapping can be made by means of an airtight and elastic foil, which is moreover capable of cohering where the layers are overlapping. As stretch foil possesses exactly this property, it will be the preferred material for this purpose, but paper based materials or other plastic foils will also be usable with suitable measures taken. Besides, stretch foil is cheap, which is a further advantage, because the first wrapping after the evacuation serves no purpose, but is on the other hand not removable and reusable. The first wrapping may therefore be quite thin, as it shall only serve the purpose of creating an improved sealing.

After the first wrapping, if any, some holding means 10 and 11 are brought into contact with the packages 2, said means being pivotally fastened to the plates 1 and 4 by means of (not shown) conventional carrying means. The holding means 11 are shown in a retracted position, whereas the holding means 10 are shown fully drawn in a tightened position, the retracted position being shown with a dotted line. Then the vacuum is connected, which makes the surrounding air compress the packages from a size, where the outline is nearly flushing with the edge of the plates 1,4, to the size shown in FIG. 1. During this process the holding means take care that the packages are not being displaced in relation to one another, the arrangement of the packages maintaining its form, normally a quadratic one. If the packages are provided with a first wrapping, the elastic foil will at the same time slide downwards along the skirts of the plates 1,4, the sealing at the ends of the packages being thereby preserved.

When the packages 2 have been compressed to the desired degree, they are provided with a second wrapping by means of the wrapping means. This wrapping should be tight-fitting and so airtight and strong, that it is able to resist the pressure from the elasticity of the mineral wool, when the vacuum is discontinued. The foil is tightened by means of a brake on the roll 9 or by means of similar means. For the wrapping either paper or a plastic foil may be used. Particularly well-suited is sealing stretch foil, which is strong and elastic, and which,due to the fact that the layers cohere all by themselves without additional adhesive, makes a welding or gluing in order to fasten the end of the foil superfluous. After the second wrapping the packaging is finished, and the finished package may be placed on a pallet,if desired, and a new packaging cycle may start.

Figure 2:
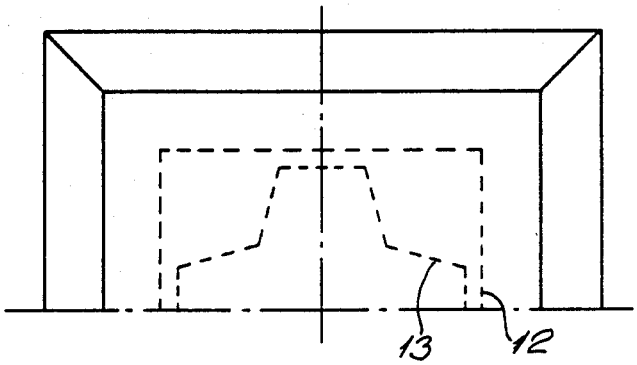
FIG. 2 part of a section along the line II—II according to FIG. 1.

The invention also comprises the apparatus used for carrying out the method, the individual parts of the apparatus being described above. To counteract the tendency of the packages to take a rounded form, whereby the mineral wool of the packages forming the corners of the arrangement may be exposed to a compression so strong that the mineral wool partly looses it ability to return to its original shape, it is advantageous that the mineral wool coils placed in the corners should not be evacuated to the same degree as the remaining ones. For this purpose the perforations in the plate 1 are placed in a particular pattern as shown in FIG. 2, which is a section along the line II—II according to FIG. 1 and which shows a part of the plate 1. After the evacuation it is advantageous that the mineral wool coils should be positioned within the outline 12 shown with dotted lines. By placing the perforations within the star-shaped outline 13, shown with dotted lines, the desired, less strong evacuation of the four corner coils is achieved, because on one hand the coils are placed with most of their section outside the perforations, when the evacuation starts, whereby the evacuation of these coils are delayed, and on the other, the area of the perforations, with which these rollers later during the evacuation get in touch with the suction box, gets small, an equilibrium between the amount of air evacuated and the amount of air seeving in through inevitable leakages being established due to the smaller degree of evacuation than in the middle packages. Another advantage is that during the first critical phase of the evacuation, where the first wrapping, if any, is to create a seal between the coils put together, the evacuation is in the beginning concentrated to the middle coils, whereby they are compressed more quickly, while the subsequent phase, under which the sealing under normal conditions has become better, also comprises the corner coils as by and by the coils are being pressed together by the surrounding air and by the holding means 10,11.

What we claim is:

1. A method for wrapping generally cylindrical packages comprising the steps of:

providing nine packages, each of said packages including a cylindrical body of insulating material, each of said bodies having sides, each of said sides being wrapped with a substantially airtight foil, each of said bodies having two ends, each of said ends being open;

arranging said packages in a group, said group including three rows, each of said rows including three of said packages; arranging each of said bodies on one of its ends; placing said packages in close relationship to each other; placing two of said packages adjacent to each other so that said two packages contact each other along a line; and arranging said nine packages so that diamond-shaped cavities are formed between said nine packages, said cavities being separated from ambient air;

closing said nine packages from above; and closing said nine packages by a perforated plate, said plate being connected to a vacuum source;

holding said nine packages together in a rectangular pattern;

evacuating said nine packages and said cavities, said evacuating including applying a vacuum from said source to said nine packages and said cavities so that said two packages remain in contact with each other after said evacuating and so that said cavities remain separated from ambient air;

substantially reducing the volume of said nine packages and deforming said nine packages to substantially fill up said cavities;

discontinuing said holding;

tightly wrapping said nine packages with foil after said discontinuing of said holding; and subsequently, discontinuing said vacuum applying.

2. A method according to claim 1, wherein:

said insulating material includes generally elastic mineral wool;

said perforated plate has a square pattern; and said closing from above includes closing said nine packages from above by a plate which is parallel to said perforated plate.

3. A method according to claim 1, wherein the positioning of said nine packages with respect to one another is retained during said evacuating.

4. A method according to claim 1, wherein:

said arranging said packages includes arranging five of said nine packages in the middle of said nine packages and arranging four of said nine packages so as to form corner packages;

said perforated plate includes a first passage for communication with said five packages and a second passage for communication with said four packages, said first passage being bigger than said second passage; and said evacuating includes applying a first vacuum to said five packages and applying a second vacuum to said four packages, said first vacuum being greater than said second vacuum.

5. An apparatus for wrapping generally cylindrical packages consisting of generally elastic insulation material such as mineral wool, the packages having open ends, the packages having side faces, the side faces being surrounded by and essentially airtight foil layer, said apparatus comprising:

means for temporarily closing the open ends of the packages in a substantially airtight way; means for connecting the volume defined by the foil layer and by said closing means to a vacuum source to reduce the volume of the packages; means for reducing the volume of the packages while the packages are enclosed in a tight enclosure before the vacuum source is disconnected from the defined volume; and wherein said closing means includes a substantially horizontal plate, said plate being capable of holding the packages in a rectangular pattern; wherein said closing means further includes another plate, said another plate having generally the same shape as said first plate, said another plate being parallel to said first plate and movable toward said first plate; and wherein one of said plates is perforated and connected to the vacuum source; and wherein said apparatus further includes holding means, said holding means being provided around said plates, said holding means being movable from an inactive position in which said holding means is completely outside of the area between said plates to a position where said holding means is adapted to press against the packages; and wherein said apparatus further includes means for wrapping the packages, said wrapping means being adapted to circle around the packages for controlled unrolling of a foil from a roll.

6. An apparatus according to claim 5, wherein:

each of said plates has a circumference; and said apparatus further includes two conical skirts, each of said skirts tapering toward a respective plate, each of said skirts being connected to said respective plate at said circumference of said respective plate.

7. An apparatus according to claim 5, wherein:

the packages include nine packages placed in a square consisting of three rows, each of the rows containing three packages; and said perforated plate includes first perforations in the shape of a four pointed star and second perforations, said first perforations being adapted to overlap five of the packages, the five packages being in the middle of the nine packages, said second perforations being adapted to overlap four of said nine packages, said second perforations being smaller than said first perforations.

8. An apparatus according to claim 5, wherein said wrapping means consists of a roll, and means for suspending said roll so that said roll can circle around the packages and so that said roll can move upward and downward while circling around the packages.

* * * * *